US006074330A

United States Patent [19]

Ostini

[11] Patent Number: 6,074,330

[45] Date of Patent: Jun. 13, 2000

[54] DEVICE FOR CONVERTING PUNCH CHANGING IN PUNCHING MACHINES FROM MANUAL TO QUICK AND AUTOMATIC

[75] Inventor: Giorgio Ostini, Grono, Switzerland

[73] Assignee: Euromac S.r.l., Formigine, Italy

[21] Appl. No.: 09/062,302

[22] Filed: Apr. 17, 1998

[30] Foreign Application Priority Data

May 1, 1997 [GB] United Kingdom ..... 9708930

[51] Int. Cl.[7] ..... B21D 28/02

[52] U.S. Cl. ..... 483/29; 72/442; 83/552

[58] Field of Search ..... 483/28, 29; 72/442, 72/446, 448; 83/549, 552; 29/35.5, 39, 43, 33 J

[56] References Cited

U.S. PATENT DOCUMENTS

| | | | |
|---|---|---|---|
| 4,929,276 | 5/1990 | Chun et al. | 83/552 |
| 4,998,958 | 3/1991 | Chun et al. | 83/552 |
| 5,012,712 | 5/1991 | Nordquist | 83/549 |
| 5,048,385 | 9/1991 | Eckert et al. | 83/34 |
| 5,062,337 | 11/1991 | Johnson et al. | 83/552 |
| 5,382,102 | 1/1995 | Brolund et al. | 83/552 |
| 5,425,692 | 6/1995 | Matsuda | 483/29 |
| 5,545,116 | 8/1996 | Seto | 483/29 |
| 5,848,563 | 12/1998 | Saito | 83/552 |

FOREIGN PATENT DOCUMENTS

| | | | |
|---|---|---|---|
| 0 579 217 A1 | 1/1994 | European Pat. Off. . | |
| 1176964 | 8/1964 | Germany | 83/552 |
| 6-39456 | 2/1994 | Japan | 83/552 |
| 2 195 937 | 4/1988 | United Kingdom . | |
| 2 234 931 | 2/1991 | United Kingdom . | |
| 2 257 081 | 1/1993 | United Kingdom . | |

*Primary Examiner*—Daniel W. Howell
*Attorney, Agent, or Firm*—Fenwick & West

[57] ABSTRACT

A device for converting punch changing in punching machines from manual to quick and automatic comprises: a stator element, which can be inserted in a corresponding and conventional seat provided in the machine and supports a plurality of punches which are arranged vertically in a circular pattern and can slide in corresponding hollow seats; a rotor element, which can be rotated by corresponding elements coaxially inside the stator and is eccentrically provided with a pusher which can be aligned, through gradual rotations of the rotor element, so as to be coaxially vertical above each one of the punches; the rotor element can also be moved vertically by an extent inside the stator, in contrast with elastic elements and guided by stem-like elements which are rigidly coupled to the stator element.

18 Claims, 3 Drawing Sheets

DEVICE FOR CONVERTING PUNCH CHANGING IN PUNCHING MACHINES FROM MANUAL TO QUICK AND AUTOMATIC

BACKGROUND OF THE INVENTION

The present invention relates to a device for converting the punch changing in punching machines from manual to quick and automatic.

In conventional punching machines it is constantly necessary to replace the punch depending on the kind of machining to be performed on the parts.

These punches are usually snugly inserted in a corresponding seat provided at the end of an arm which is in turn articulated to the frame that supports the hammer, so that it can be rotated from an idle position, which is directed outwards, to an active position which is located exactly below said hammer and is perfectly coaxial thereto.

Whenever the machining must be changed, it is necessary to manually remove the punch being used and then equally manually replace it with the punch to be used subsequently.

This method entails a plurality of manual actions which require some time for completion and therefore negatively affect the overall performance of punching machines.

SUMMARY OF THE INVENTION

The aim of the present invention is to solve the above problems of the prior art, by providing a device for converting the punch changing in punching machines from manual to quick and automatic which allows to perform said changing quickly and precisely, without the manual intervention of operators.

This aim and other objects are achieved by a device for converting punch changing in punching machines from manual to quick and automatic, characterized in that it comprises: a stator element, which can be inserted in a corresponding and conventional seat provided in said machine and supports a plurality of punches which are arranged vertically in a circular pattern and can slide in corresponding hollow seats; a rotor element, which is actuatable by corresponding elements to coaxially rotate inside said stator, is controlled by sensor means, and is eccentrically provided with a pusher means that protrudes from the lower face and can be aligned, through gradual rotations of the rotor element which are controlled by said sensor means, so that it is coaxially vertical above each one of said punches, said rotor element being also vertically movable in a punching configuration by a preset extent inside the stator, in contrast with elastic means and guided by stem-like means which are rigidly coupled to said stator element.

BRIEF DESCRIPTION OF THE DRAWINGS

Further characteristics and advantages of the present invention will become apparent from the following detailed description of a preferred embodiment of a device for converting the replacement of punches in punching machines from manual to quick and automatic, illustrated only by way of non-limitative example in the accompanying drawings, wherein.

DESCRIPTION OF THE PREFERRED EMBODIMENTS

Figure 1:
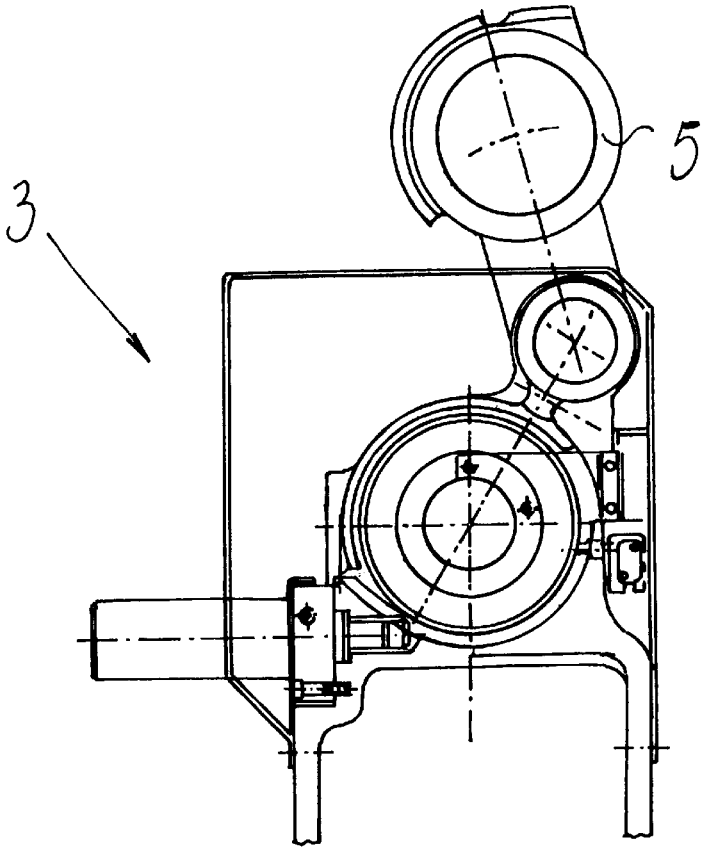
FIG. 1 is a top view of a punch supporting arm of a punching machine provided with a support for accommodating the punch.
Figure 4:
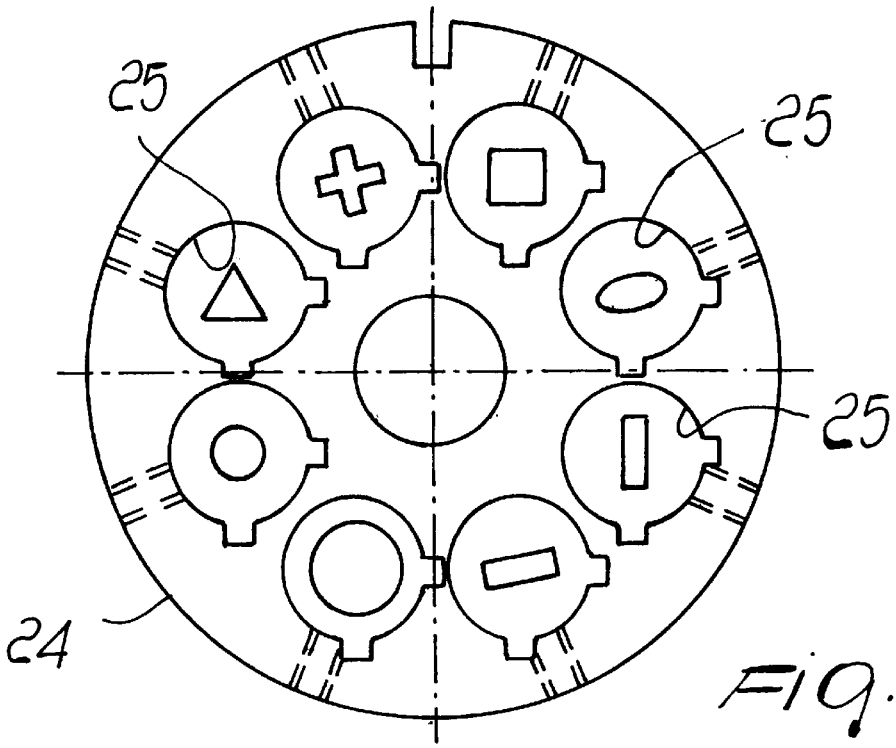
FIG. 4 is a top view of a carousel inserted in the worktable of the punching machine.
Figure 2:
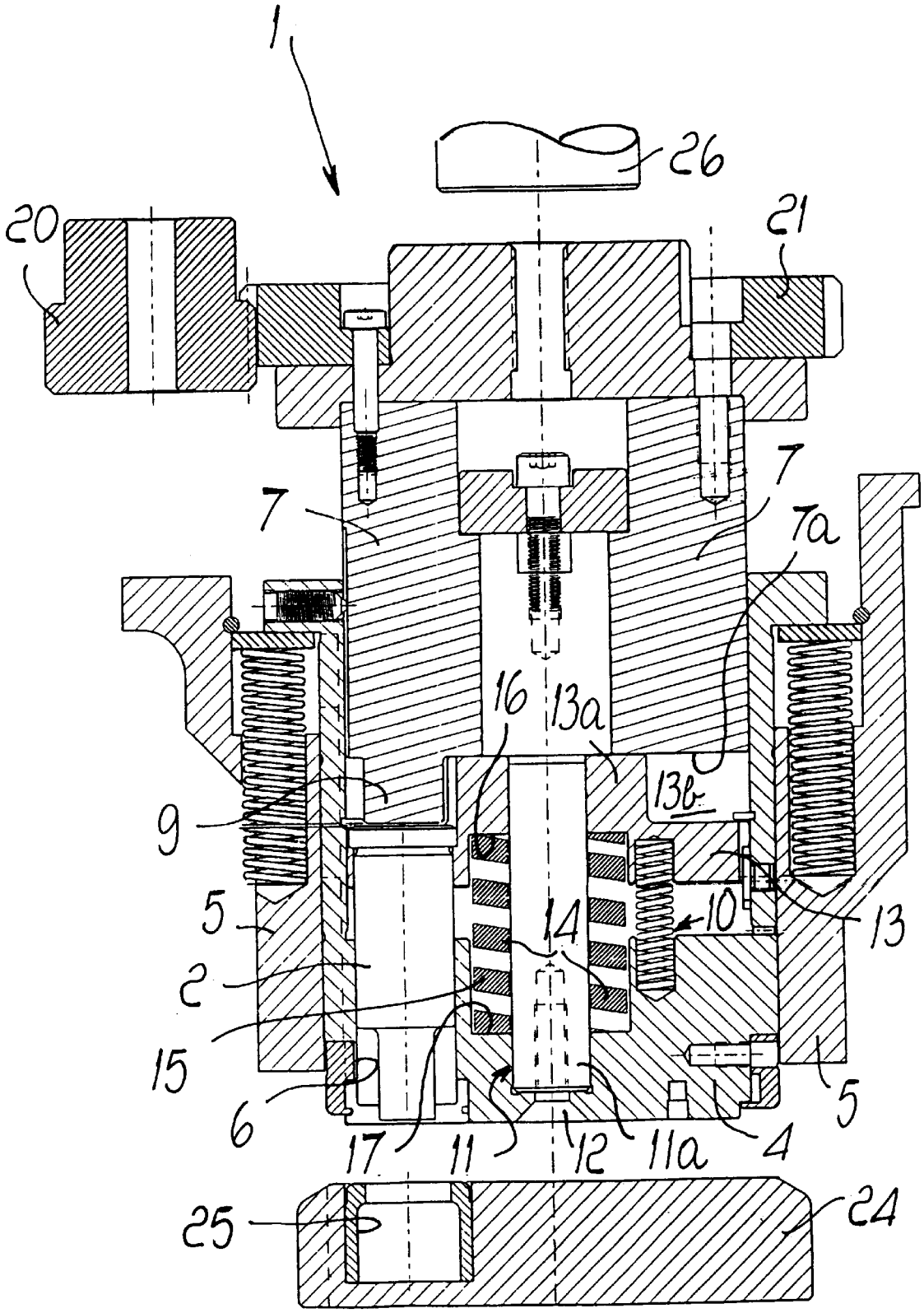
FIG. 2 is a vertical sectional view of the device according to the present invention.
Figure 3:
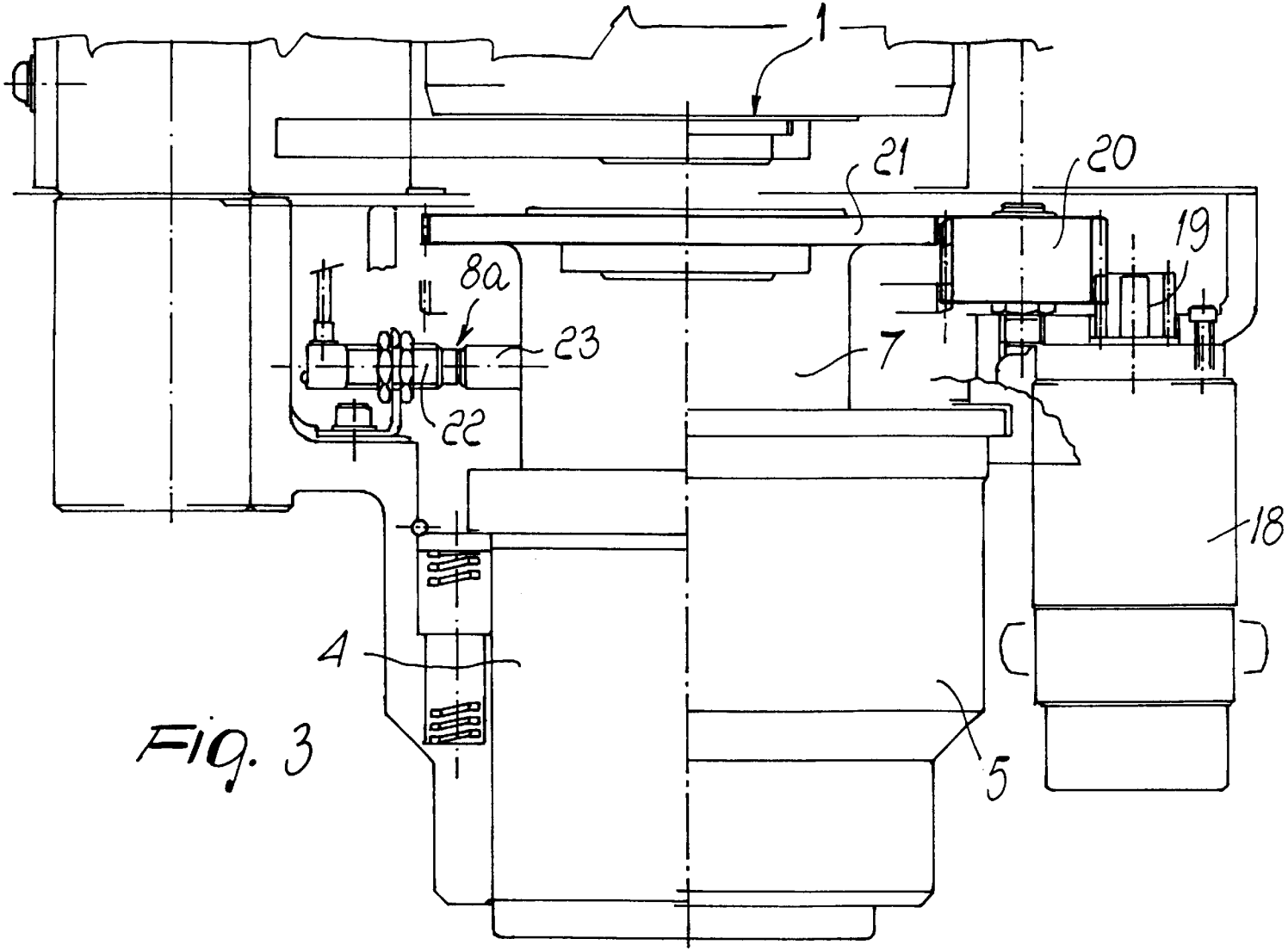
FIG. 3 is a schematic view of the configuration for the normal assembly of the invention.

With particular reference to the above figures, the reference numeral 1 generally designates a device for converting changing of punches 2 in punching machines 3 from manual to quick and automatic.

The device 1 comprises a stator element 4, which can be inserted in a corresponding conventional seat 5 provided in said conventional machine 3.

The stator element 4 supports a plurality of vertical punches 2 which are arranged in a circular pattern in plan view and can slide in corresponding hollow seats 6.

A rotor element 7 is fitted inside said stator element 4 and can be rotated by corresponding elements 8; the rotations are controlled by corresponding sensor means 8*a* described hereinafter.

The rotor element 7 is mounted coaxial inside the stator 4 and is eccentrically provided with a pusher tooth 9 that protrudes from the lower face 7*a* and can be aligned, through gradual rotations of the rotor element 7, so as to be coaxially vertical over each one of said punches 2.

The rotor element 7 can also be moved vertically by a preset extent inside the stator 4 in contrast with elastic means 10 and is guided by stem-like means 11 which are rigidly fitted on the stator element 4.

Said stator element is substantially constituted by a cup-shaped cylindrical body, from the center whereof said stem-like means 11 rise.

Said stem-like means are in turn constituted by a vertical cylindrical hub 11*a* associated, by screw means 12, with the bottom of the stator element 4 and from which, as mentioned, it protrudes upwards in a centered position.

A perforated disk 13 for slidingly accommodating the punches 2 and elastic means 14 for contrasting compression are coaxially fitted on the hub 11*a* and are interposed between said rotor element and the bottom of the stator element 4; said elastic means are substantially constituted by at least one first helical spring 15 in which the turns wind perimetrically around the hub 11*a* and the ends are inserted so as to rest in corresponding hollow seats 16 and 17 formed respectively in the lower portion of said disk 13 and in the upper portion of the bottom of said stator element 4.

Said disk 13 is centrally provided with a raised portion 13*a* which protrudes upwards and abuts against the lower face 7*a* of the rotor 7; an annular chamber 13*b* is formed therebetween, and the pusher tooth 9 can slide in said annular chamber to reach the positions which are centered on the various punches 2.

The means 8 for rotating the rotor element 7 comprises at least one gearmotor unit 18, which is associated with the frame of the punching machine 3 and has, at its output, a pinion 19 having a vertical axis and adapted to engage a contiguous idler gear 20 for transmission to a ring gear 21 formed rigidly and perimetrically with respect to the upper end of the rotor element 7.

The idler gear 20 advantageously has a thickness which is at least equal to the extent of the vertical motion that the rotor element 7 can perform inside the stator 4.

The sensor means 8*a* comprises a photocell 22 which is associated with the frame of the punching machine 3 and is adapted to be aligned with a locator 23 that acts as so-called "zero set point" and is radially fixed to the rotor element 7.

A carousel 24 is provided in a downward region and in vertical alignment with respect to the stator element 4 and coaxially thereto; said carousel is affected by a number of seats 25 which is equal to the total number of punches 2 carried by the stator element 4 and is provided with the same impressions as said punches, whilst the hammer 26 is located above the rotor element 7.

Operation of the present invention is as follows: the stator element 4, which has a given number of punches 2, each having its own impression, arranged substantially like the bullets in the cylinder of a revolver, is inserted in the seat 5 with which punching machines 3 are normally provided.

The carousel 24 is located in vertical alignment with respect to said seat and is inserted in the underlying worktable; the seats 25 are formed in said carousel, have the same impressions as each punch, and the corresponding active end of each one of said punches enters said seats.

The rotor element 7 is rotated inside the stator 4 by the gearmotor unit 18, which transmits the rotary motion to the ring gear 21 by means of the interposed idler gear 20 that engages the pinion 19.

Said rotary motion occurs by steps and the rotation arcs are preset by the motor 18 and controlled by a computer which performs the general management of the punching machine.

The sensor 22 has the task of checking the zero set point wherefrom the rotation steps begin.

At every arc of rotation, the rotor element 7 vertically aligns the pusher tooth 9 above each one of the punches 2 and stops when the punch chosen for punching is reached.

The hammer 26 descends and presses on the rotor element 7, which moves downwards without losing the meshing between the ring gear 21 and the idler gear 20 which has, for this purpose, a thickness which is at last equal to the useful stroke of said hammer 26.

The movement of the rotor element 7 entrains the disk 13 therewith it and consequently compresses the spring 14, loading it.

Simultaneously, the selected punch 2 moves down and perforates the metal plate, which is appropriately inserted on the worktable between the carousel 24 and the lower end of the stator element 4.

The remaining punches 2 do not move with respect to the disk 13 and their upper end occupies the empty annular chamber 13*b* without thus interfering with the descent of the rotor element 7.

The vertical movement of said rotor element is guided by the vertical cylindrical hub 11*a*, which is rigidly coupled to the bottom of the stator element 4 by means of the screw 12.

Once punching has been completed, the pressure of the hammer 26 on the rotor element 7 ceases and the spring 14 elongates spontaneously and removes the punch 2 from the seat 25 and from the punched metal plate.

Once elongation has been completed, the rotor element 7 is ready for subsequent rotations for positioning above other punches 2 provided with other impressions.

It has thus been observed that the described invention achieves the intended aim and objects.

The invention thus conceived is susceptible of modifications and variations, all of which are within the scope of the inventive concept.

All the details may also be replaced with other technically equivalent elements.

In the practical embodiment of the invention, the materials used, the shapes and the dimensions may be any according to requirements without thereby abandoning the scope of the protection of the appended claims.

What is claimed is:

1. A punch changing kit, mountable in a punch seat of a single tool holder punching machine, for automatic punch changing, comprising: a punch supporting element provided with punch hollow seats; a plurality of punches supported by the punch supporting element and arranged vertically in a circular pattern, the punches being slidable in corresponding ones of said hollow seats; a rotor element arranged to be vertically movable and rotatable with respect to said punch supporting element; actuation elements for actuating said rotor element to coaxially rotate inside said punch supporting element; pusher means for pushing said punches, said pusher means being arranged so as to protrude eccentrically from the lower face of said rotor element and to be alignable, through gradual rotations of the rotor element, for being arranged coaxially vertical above each one of said punches; elastic means for contrasting vertical movement of said rotor element while moving by a preset extent in a punching configuration inside the punch supporting element; and sensor means for establishing a set point from which the controlled gradual rotation of said rotor element is to be started, and wherein said punch supporting element is fixedly insertable in the punch seat of the punching machine to form a stator element, said stator element including stem-like means rigidly coupled thereto for guiding the rotor element during the vertical motion thereof.

2. The kit of claim 1, wherein said stator element is constituted by a cup-shaped cylindrical body, from the center whereof said stem-like means for guiding the rotor element rises.

3. The kit of claim 2, wherein said stem-like means comprises screw means, and a vertical cylindrical hub which is associable through said screw means with a bottom part of said stator element, said hub protruding upwards in a centered position of said bottom part of the stator element.

4. The kit of claim 3, further comprising a perforated disk for slidingly accommodating said vertical punches, and further compression elastic means, said perforated disk and further elastic means being fitted coaxially on said hub so as to be interposed between said upper rotor element and the bottom part of the stator element.

5. The kit of claim 4, wherein said disk is provided with a central raised portion that protrudes upwards and abuts against an opposite lower face of said rotor element so as to form an annular chamber in which said pusher means are slidable for pushing said punches.

6. The kit of claim 5, wherein said pusher means is constituted by a tooth that protrudes from the lower face of said rotor element.

7. The kit of claim 4, further comprising corresponding hollow accommodation seats, formed in a lower portion of said disk and in an upper portion of the bottom of said stator element, respectively, said further compression elastic means being constituted by at least one first helical spring with turns whereof wound perimetrically around said hub and ends whereof accommodated in said accommodation seats formed in the lower portion of said disk and in the upper portion of the bottom of said stator element.

8. The kit of claim 7, wherein said actuation elements for actuating said rotor element comprises at least one gearmotor unit which is associated with the punching machine, said gearmotor unit including a motion transmission pinion having a vertical axis, a contiguous idler gear, and a ring gear arranged perimetrically at an upper end of said rotor element, said pinion meshing with the idler gear for transmitting motion to said ring gear.

9. The kit of claim 8, wherein said idler gear has a thickness which is at least equal to an extent of the vertical movement of the rotor element in said stator element.

10. The kit of claim 1, wherein said sensor means are constituted by an optical-electronic detector associated with said punching machine, proximate to said rotor element, and by at least one corresponding reflector-sensor associated therewith, said detector being alignable with said at least one corresponding reflector-sensor.

11. A device for converting punch changing in punching machines from manual to quick and automatic, comprising: a stator element with corresponding punch hollow seats, which is insertable in a conventional accommodation seat provided in said machine; a plurality of punches supported by the stator element and arranged vertically in a circular pattern, the punches being slidable in said hollow seats; a rotor element being vertically movable in said stator element; actuation means for actuating said rotor element to coaxially rotate inside said stator; sensor means for controlling gradual rotation of said rotor element; pusher means for pushing said punches, said pusher means protruding eccentrically from the lower face of said rotor element and being alignable, through gradual rotations of the rotor element controlled by said sensor means, to be located coaxially vertical above each one of said punches; elastic means for contrasting vertical movement of said rotor element by a present extent, inside the stator, to a punching configuration; stem-like means which are rigidly coupled to said stator element for guiding in vertical movement said rotor element, said stem-like means being constituted by a vertical cylindrical hub which is associable with a bottom part of said stator element and wherefrom the hub protrudes upwards in a centered position; a perforated disk for slidingly accommodating said vertical punches; and further elastic means for contrasting compression, said perforated disk and further elastic means being fitted coaxially on said hub and being interposed between said rotor element and the bottom part of the stator element.

12. The device of claim 11, wherein said stator element is constituted by a cup-shaped cylindrical body, from the center whereof said stem-like means for guiding the rotor element rises.

13. The device of claim 12, wherein said disk is provided with a central raised portion that protrudes upwards for abutment against the opposite lower face of said rotor element, said raised portion forming an annular chamber in which said pusher means is allowed to slide.

14. The device of claim 13, wherein said pusher means is constituted by a tooth that protrudes from a lower face of said rotor element.

15. The device of claim 12, wherein said further elastic means for contrasting compression is constituted by at least one first helical spring the turns whereof are wound perimetrically around said hub and the ends whereof are accommodated in corresponding hollow seats formed respectively in a lower portion of said disk and in an upper portion of the bottom part of said stator element.

16. The device of claim 12, wherein said actuation means for rotating the rotor element comprise at least one gearmotor unit which is associated with said punching machine, said gearmotor unit being provided with a pinion having a vertical axis, with a ring gear formed perimetrically with respect to an upper end of said rotor element, and with an idler gear meshing with said pinion and with said ring gear for transmitting motion from the pinion to said ring gear.

17. The device of claim 16, wherein said idler gear has a thickness which is at least equal to the extent of the vertical movement of the rotor element in the stator.

18. The device of claim 12, wherein said sensor means are constituted by an optical-electronic detector associated with said punching machine proximate to said rotor element, and by at least one corresponding reflector-sensor, said detector being alignable with said at least one reflector-sensor.

* * * * *